United States Patent [19]

Michelson

[11] 4,045,018

[45] Aug. 30, 1977

[54] DOCUMENT DESKEWING APPARATUS

[75] Inventor: Gunnar P. Michelson, Van Nuys, Calif.

[73] Assignee: NCR Corporation, Dayton, Ohio

[21] Appl. No.: 723,687

[22] Filed: Sept. 16, 1976

[51] Int. Cl.[2] ..... B65H 9/16

[52] U.S. Cl. ..... 271/251

[58] Field of Search ..... 271/10, 226, 248, 250–252, 271/272–274

[56] References Cited

U.S. PATENT DOCUMENTS

| | | | |
|---|---|---|---|
| 2,767,982 | 10/1956 | Noon | 271/274 X |
| 2,995,364 | 8/1961 | Frederick et al. | 271/251 |
| 3,084,931 | 4/1963 | Hanson | 271/250 |
| 3,107,089 | 10/1963 | Lockey | 271/251 |
| 3,148,877 | 9/1964 | Brearly | 271/251 |
| 3,614,091 | 10/1971 | Bernardis | 271/251 |
| 3,635,466 | 1/1972 | Townsend | 271/251 |

*Primary Examiner*—Robert W. Saifer
*Attorney, Agent, or Firm*—J. T. Cavender; Wilbert Hawk, Jr.; George J. Muckenthaler

[57] ABSTRACT

A plurality of drive rollers, flexibly supported, are positioned along the inside track of a document transport passageway to drive the documents therealong, and a plurality of idler rollers, in opposed relationship to the drive rollers, are positioned along the outside track of the passageway. Each of the drive rollers and the idler rollers is supported from a pivot pin offset from the center of the roller to permit the roller to be canted by reason of gravity and elastic force, and thereby drive the documents in a forwardly and downwardly direction against a fixed edge guide to insure straight and longitudinal travel of the documents at a predetermined level along the passageway.

14 Claims, 7 Drawing Figures

DOCUMENT DESKEWING APPARATUS

BACKGROUND OF THE INVENTION

In the art of document handling it is desirable that the documents be maintained in a straight position throughout the extent of transport so as to be able to better control the attitude of each document during the processing thereof. The documents are caused to be moved along a pathway from a hopper past a feed mechanism, a separator mechanism, and a deskewing area to present each succeeding document in a correct position for reading thereof or for printing thereon. Various ways and means for correctly positioning each document have been utilized wherein opposed rollers of different document-contacting surface material provide drive or urgence of the document into a straight position, or opposed rollers are journaled at an angle from the horizontal to continually force each document towards an aligned position.

Representative prior art in the document aligning field include U.S. Pat. No. 2,995,364, issued to H. M. Frederick et al., which discloses item feeding and aligning apparatus wherein a plurality of opposed rollers are inclined at different angles to drive the items toward a horizontally aligned position. U.S. Pat. No. 3,070,204, issued to R. S. Bradshaw, discloses sheet handling apparatus having sets or series of feed rollers with tension springs urging the sets of rollers toward each other to maintain an edge of the sheets in alignment against the base of the sheet pathway. And U.S. Pat. No. 3,635,466, issued to G. A. Townsend, discloses an elastic mounting assembly having two sets of flexural members with a roller positioned for moving a document into registration with an aligning surface.

SUMMARY OF THE INVENTION

The present invention relates to document transport systems and more specifically to apparatus for advancing documents in successive manner while simultaneously and concurrently providing a bias or urgence on each document to place its lower longitudinal edge against a sorter-fixed edge guide which is disposed in a direction parallel to the document deskewing path and along and on which the document then slides. A plurality of drive rollers are positioned along the inside track of the document pathway, and a plurality of idler rollers are positioned along the outside track of the pathway in a manner that each drive roller is opposed by an idler roller, the latter being movably mounted and spring loaded against the former so as to pinch the document between the rollers, thus enabling the drive roller to exert a frictional force on the document for moving same along the pathway. Each one of the drive rollers and the idler rollers is journaled in a roller mount which is disposed on a pivot pin oriented perpendicular to the plane of the document and offset from the center of the roller at a point upstream between the center of the roller and its periphery.

The downward pivoting motion of the roller mount is limited by means of a sorter-fixed stop to a small angle in the order of magnitude of 1° or 2°, depending on the length of the deskewing path and the maximum initial displacement of the document from the edge guide. The hub of each drive roller is connected to the shaft of a sorter-fixed, journaled drive pulley by means of a flexible coupling which transmits the drive torque from the drive pulley to the drive roller and which, together with gravity, urges the drive roller mount against the stop, but which is sufficiently flexible to permit the pivoting motion of the drive roller mount. A thin-walled, metal bellows is well-suited to be used as an elastic coupling since such bellows combines adequate torsional strength and stiffness with low longitudinal and bending stiffness.

In view of the above discussion, the principal object of the present invention is to provide an improved deskewing apparatus.

Another object of the present invention is to provide drive rollers and cooperating idler rollers for advancing documents along a pathway under controlled handling conditions.

An additional object of the present invention is to provide document advancing means whereby the documents are caused to be driven and maintained in a longitudinal position.

A further object of the present invention is to provide a plurality of drive rollers and a plurality of copperating idler rollers wherein the idler rollers are suspended from a pivot point offset from the center of such rollers to allow one side thereof to engage with and to urge the documents in a downwardly direction.

Additional advantages and features of the present invention will become apparent and fully understood from a reading of the following description taken together with the annexed drawings, in which.

Figure 1:
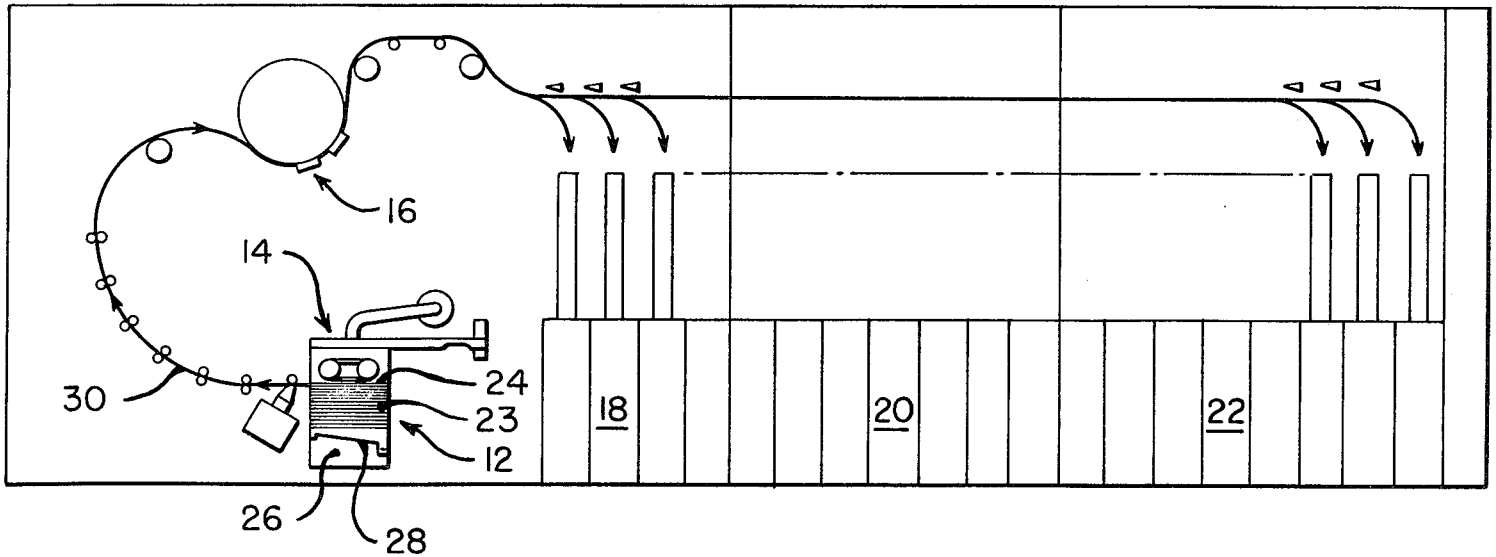
FIG. 1 is a plan view, in diagrammatic form, of document transport apparatus incorporating the subject matter of the present invention.

Referring now to the drawing, FIG. 1 shows a plan view, in diagrammatic form, of the arrangement of the various areas or sections of a document sorting machine, there being generally a hopper section 12, a feeder area 14, a read area 16 (a write or endorse area, if desired, may be adjacent or downstream of the read area) and stacking or pocket areas 18, 20, and 22. The document separating mechanism and the pocket areas include structures which are the subject matter of two copending applications, respectively, Ser. No. 723,693, filed Sept. 16, 1976, and Ser. No. 723,694, filed Sept. 16, 1976, and assigned to the same assignee as the present application. The pocket area 18 is a basic unit which may be utilized for limited operation and which may include, for example, one to six pockets, the pocket area 20 being an add-on unit to provide more pockets, say a total of 12 pockets, and the pocket area 22 being a further add-on unit to provide still more pockets for the sorted checks or documents. The number of pockets, of course, will depend upon the extent of the operation desired or necessitated by the results to be obtained. Generally, these document sorters are set up in modular fashion wherein the number of pockets in each module may be a multiple of six, and wherein an extra pocket is provided at the end of the machine to accommodate those documents which are not selected for a particular pocket.

Figure 2:
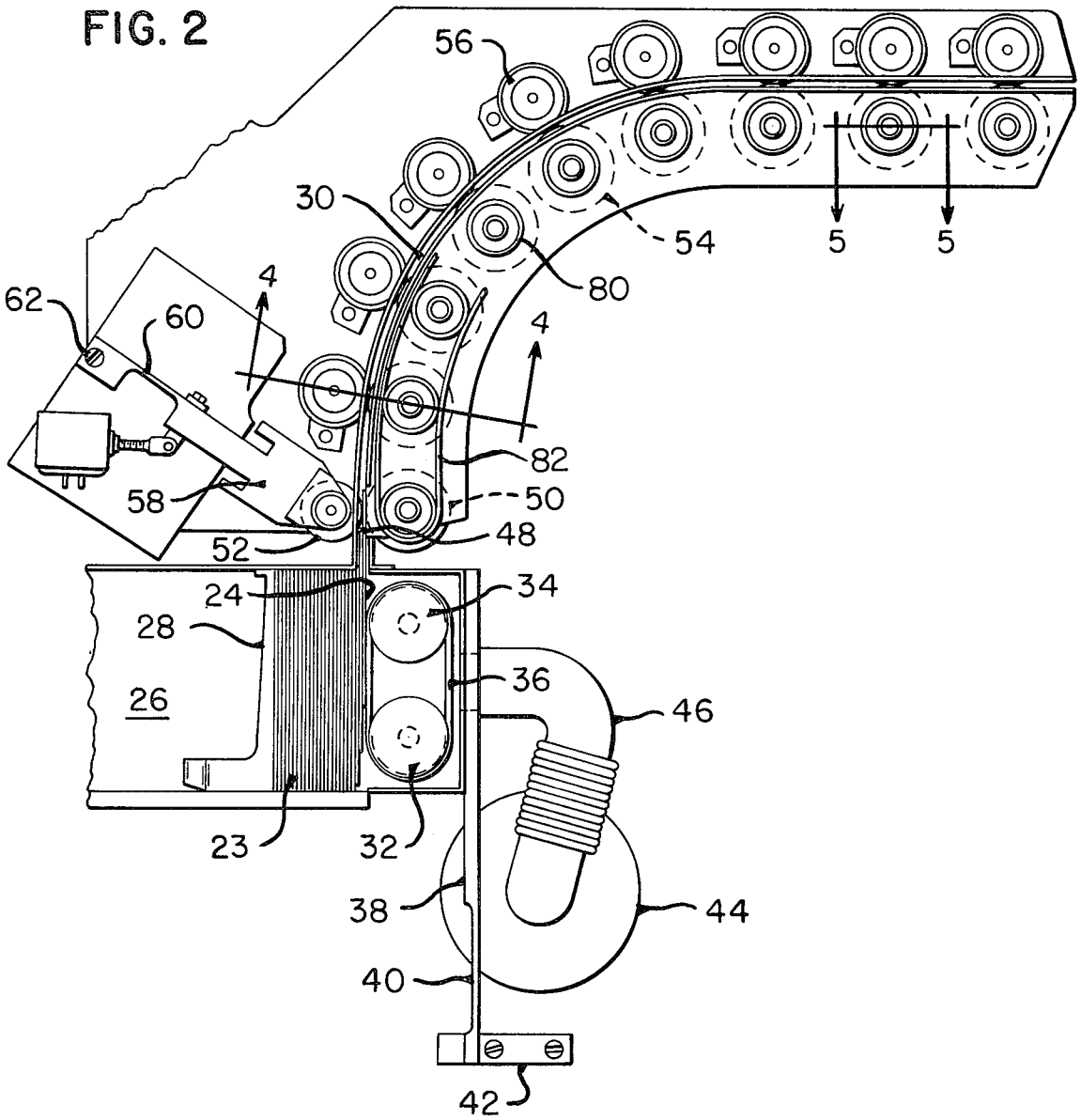
FIG. 2 is an enlarged plan view showing the preferred construction of the drive rollers and cooperating idler rollers.

The hopper section 12 is set at an angle upwardly toward the feeder area 14, there being a stack 23 of documents 24 in the hopper 26. These documents are urged by an arm 28, upwardly (FIG. 1) at an angle toward feeding mechanism which feeds each document into the document transport path 30 and toward the pocket area. The feed mechanism includes generally a pair of feed pulleys 32 and 34 (FIG. 2) with at least one belt 36 trained therearound, although the specific construction includes five belts around pulleys stacked to provide feed or drive means for each document. The feed mechanism is driven by an appropriate motor (not shown) and is supported in cantilever manner by means of an arm 38, having a reduced portion 40 for certain flexibility therein, and secured to the frame of the document sorter by a bolted bracket 42. Vacuum means in the form of a pump 44 and a hose 46 is utilized to draw the uppermost document 24 against the drive belts 36 so as to provide positive feeding of each document in successive manner.

As each uppermost document 24 is driven from the stack 23 thereof, it is directed toward and through a throat 48 formed by a drive wheel or roller 50 and an idler wheel or roller 52, the drive wheel 50 being the first of a plurality of drive members positioned along the document path 30 to maintain driving force on the documents 24 as they are successively transported toward the pocket area.

The first idler roller 52 is braked in retarding fashion and is journaled in a support member 58 which has a flexible portion 60 which portion acts as a pivot to provide a small movement of the idler roller 52 for the purpose of separation of the documents inadvertently fed multiple from the hopper 26. The document separator is not a part of this invention and, therefore, will not be discussed further.

Figure 3:
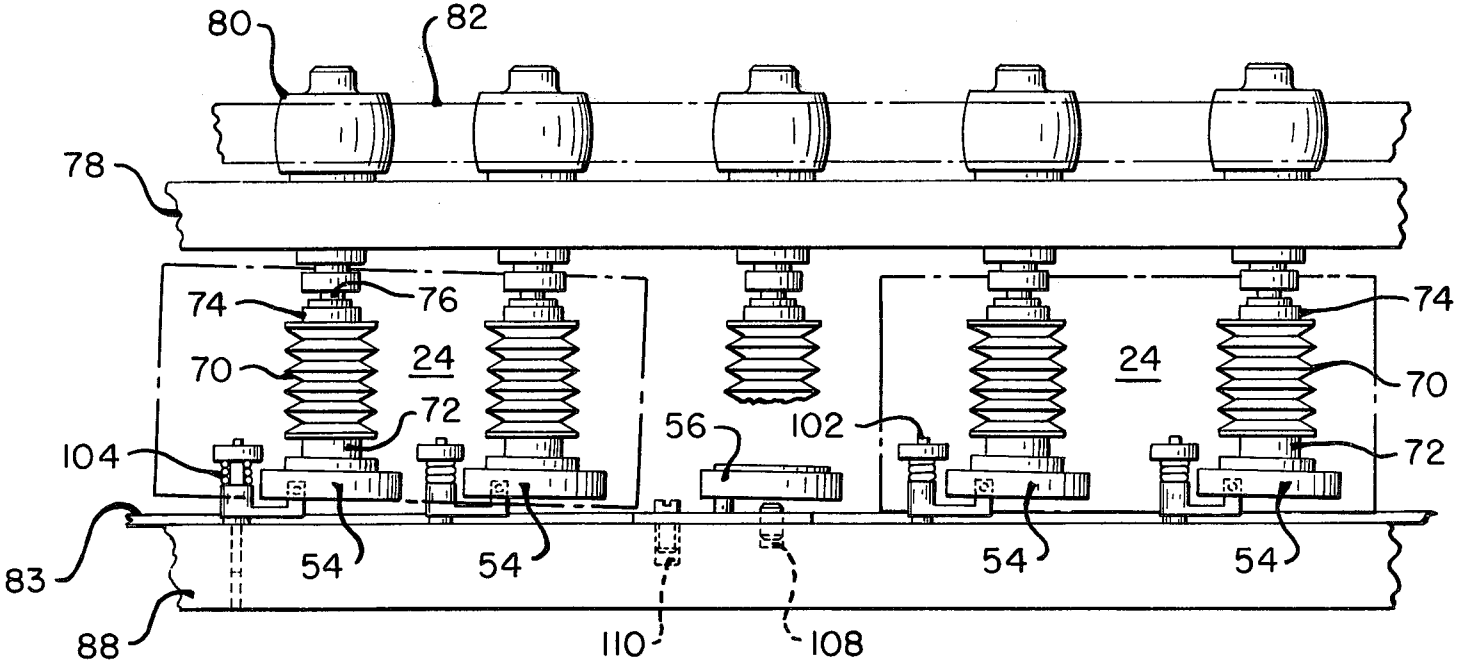
FIG. 3 is an elevational view showing the driving of a document in a forwardly and downwardly direction.
Figure 4:
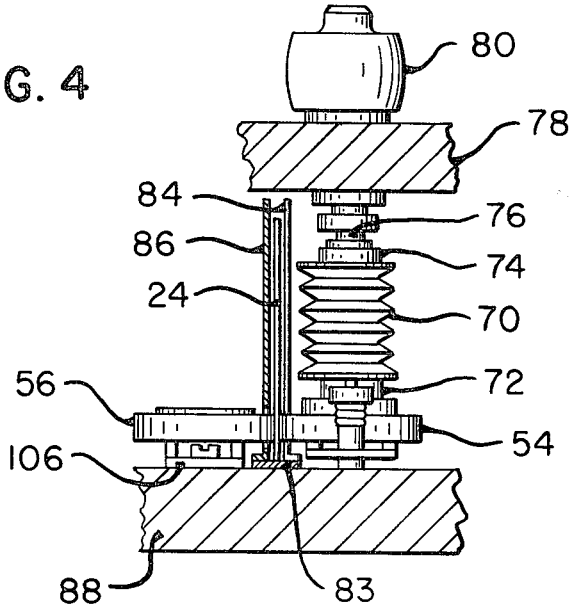
FIG. 4 is a sectional view taken on the plane 4—4 of FIG. 2.

The drive rollers 54 and the idler rollers 56 are shown in cooperating relationship in FIGS. 3 and 4, each of the rollers 54 being suspendingly supported by means of a flexible coupling member 70 which is secured at one end thereof to a hub 72 of the drive roller 54 and secured at the other end thereof, by means of a hub or bushing 74, to a shaft member 76, which shaft member is journaled in a supporting frame member 78, the shaft 76 being secured to a drive pulley 80 driven by a belt 82. The travel of the document 24 in FIG. 3 is from left to right to view the effect that the driving roller 54 and the idler roller 56 have on the document to move the document from a displaced position and possibly canted attitude as shown by the document 24 on the left compared to the document 24 on the right which is shown sliding on the edge guide 83 in a straight manner or attitude, it being desired, of course, that the document be made to travel in a straight or level path and with its lower edge situated at a predetermined level along the route past the read area and toward the pocket area.

The path or route 30 of the documents 24 may be defined by a pair of sheet metal members 84 and 86 (FIG. 4) to contain the documents in such straight and upright attitude, the documents being driven at the lower portion thereof by the drive roller 54, and cooperating with the idler roller 56 which is also engageable with the lower portion of the document and continually biases or urges such document in a downwardly direction to cause the document to ride in a straight plane on the edge guide member 83.

Figure 5:
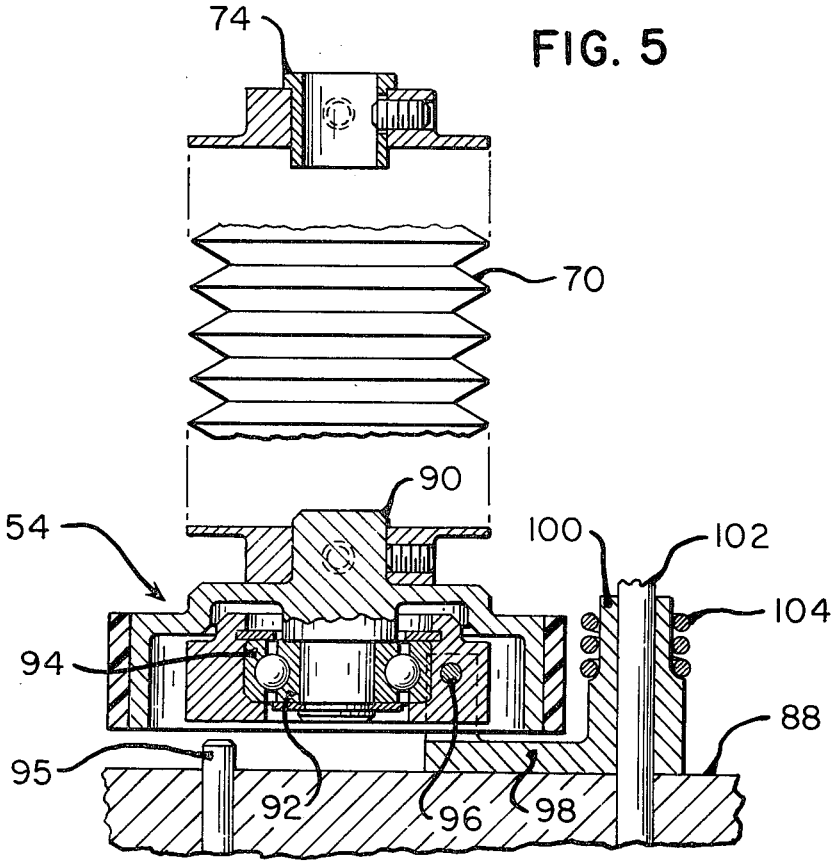
FIG. 5 is an enlarged view taken on the plane 5—5 of FIG. 2, showing the drive roller and its mounting structure.

The drive roller 54, shown in FIGS. 3, 4 and 5, is supported by the flexible coupling 70, it being seen that the shaft 76 is rotated by the pulley 80 and is connected to the hub 74 of the coupling 70 for driving thereof, the coupling 70 also being connected to a portion 90 of the drive roller 54 which portion is connected with the inner race 92 of the bearing. The outer race 94 of the bearing is supported by means of a pivot pin 96 to a bracket 98 which has an upright portion 100 for a pin 102, disposed at the sorter frame 88 (FIGS. 3 and 5) to anchor the bracket 98, there being a torsion spring 104 atop the bracket 98 to provide a small preload of the idler roller 56 against the drive roller 54. Secured in the frame 88 of the sorter is a stop 95 for each roller 54 and a stop 97 for each roller 56, which limits the vertical pivoting motion of each roller.

Figure 6:
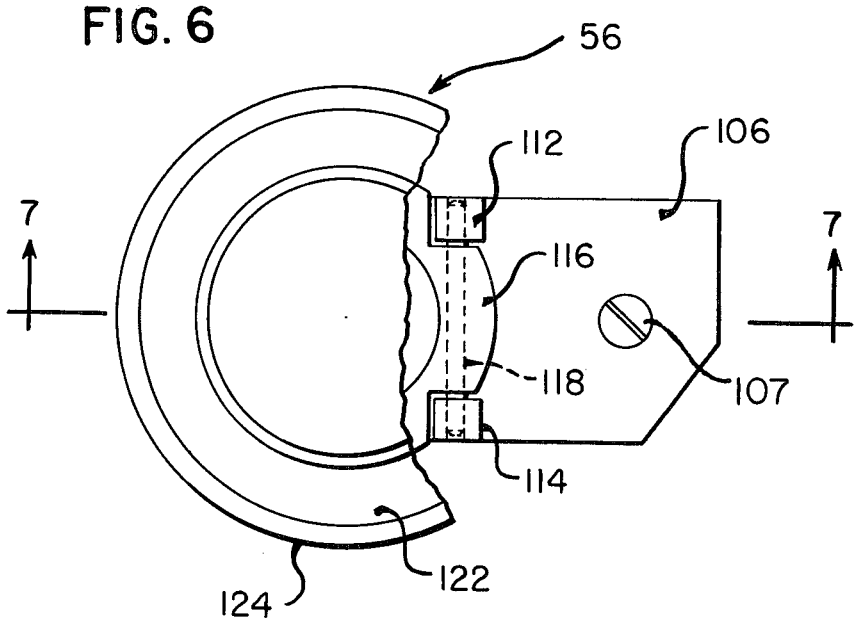
FIG. 6 is an enlarged plan view of the idler roller.
Figure 7:
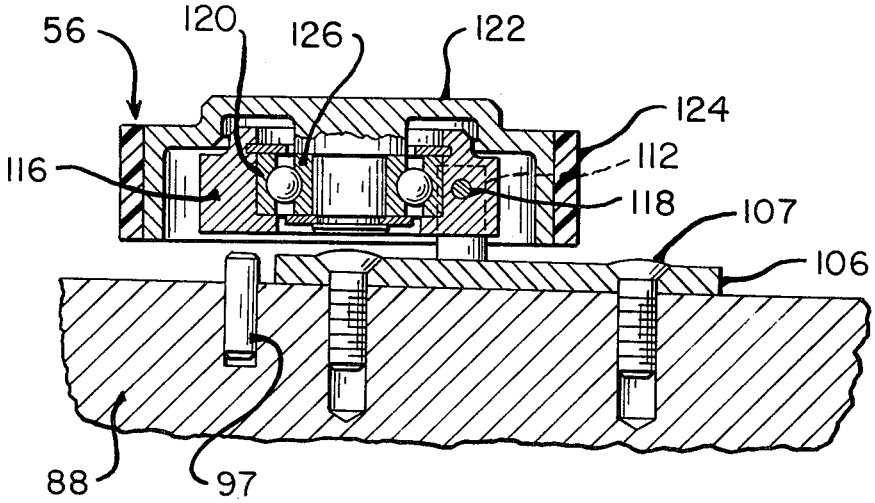
FIG. 7 is a sectional view taken on the plane 7—7 of FIG. 6, showing the idler roller and its mounting structure.

In FIG. 6 is shown an enlarged plan view of the idler roller 56 and in FIG. 7 is shown a cross-section through the roller. The outer race 120 of the bearing is contained in a bearing mount 116 which is supported from the upright portions 112 and 114 of a plate member 106 by means of a pivot pin 118. The plate member 106 is held to the frame 88 of the sorter by means of screws 107, such frame also containing the stop 97 for the roller 56. The periphery 124 of the idler roller 56 is made of a frictional type material such as soft plastic or the like for contact with the document and is connected with the inner race 126 of the bearing through the shell 122 of the idler roller.

In the operation of the mechanism, as the documents 24 are driven by the drive rollers 54 along the path or route toward the pocket area, the support for and construction of the drive rollers permits or enables the rollers to exert a slight downward force on the documents, by reason of the flexible coupling suspension and the off-center pivot points 96. Likewise, the pivot pin 118 for each idler roller 56 is offset from the center of the roller to cause the roller to be canted or tilted by reason of gravity and thereby drive the documents in a downwardly direction to insure horizontal travel of the documents along the passageway.

When there is no document 24 present, each idler roller 56 will ride on or against its corresponding drive roller 54 with both their axes slightly tilted forward and parallel to each other and with the roller mounts resting against the stops 95 and 97. The instant a document 24 arrives in the pathway 30, such document will be pinched between the drive roller 54 and its mating idler roller 56 and, after a very short downward acceleration period, the document will, while maintaining its forward velocity, assume a small downward velocity, the ratio of these velocities being equal to the tilt angle of the rollers 54 and 56.

As soon as the lower edge of each document 24 reaches the edge guide 83 of the deskewing path 30, the downward motion of the document will cease and, after a very short acceleration period, the rollers 54 and 56 will ride upward on the document along a tractrix, thereby rotating the roller mounts about their respective pivot pins, until, when the end of the document is reached, the roller axes will be nearly erect, viz., nearly perpendicular to the deskewing path. Once the trailing edge of the document has passed, the rollers, urged by the elastic force of the coupling and by gravity, will return to their initial tilted position, viz., with the roller mounts resting against the stops. For proper functioning, the friction force between the document 24 and the rollers 54 and 56 must be larger than the sum of the gravitational force and the elastic coupling force acting on the rollers.

Because of the small forces and short periods of time involved, especially when processing thin documents, it is mandatory that the moment of inertia and the mass of each roller, the moment of inertia of the roller mount about the pivot pin, and the distance between the center of the roller and the pivot pin be made as small as feasible.

The major advantage of the described invention is that the deskewing rollers essentially roll only on the document with little sliding of the rollers on the document, whereas a conventional, fixed deskewing roller, because of its constant vertical velocity component, will rub continuously on the document once the latter has bottomed on the edge guide. This rubbing, in addition to roller wear, will tend to erase the information written on the face of the document. This is especially critical in cases where some documents may be run 5 to 10 times through a sorter.

Another advantage is that the document, since it is propelled by pairs of pinching rollers, does not depend on sensitive differential friction as compared, e.g., to a document sliding on a metal surface, propelled by a rubber roller. Actually, low friction material with little erasing effect on the document may be used as a roller lining. Also, moist documents could be easily deskewed by this method, whereas a conventional method of deskewing, wherein the face of the document would have to slide on a smooth metal or similar surface, would not function well.

It is thus seen that herein shown and described is deskewing apparatus for documents which provides for urging such documents downwardly against an edge guide and for maintaining the documents in a straight and horizontal travel at a predetermined level along the document passageway. The apparatus enables the accomplishment of the objects and advantages mentioned above, and while only one embodiment of the invention has been disclosed herein, variations thereof may occur to those skilled in the art. It is contemplated that all such variations, not departing from the spirit and scope of the invention hereof, are to be construed in accordance with the following claims.

What is claimed is:

1. Apparatus for aligning documents comprising a passageway along which documents are transported in edgewise manner, rotatable drive means normally assuming an inclined attitude and engageable with the documents for driving thereof in a downwardly inclined direction along said passageway, and rotatable idler means operably associated with the documents and including bearing means pivotally supported off center of rotation of said idler means to permit said idler means to correspond with the attitude of said drive means in urging the documents into a longitudinally aligned position along said passageway.

2. The apparatus of claim 1 wherein said drive means includes flexible coupling means permitting said inclined attitude and driving relationship thereof with said idler means to urge the documents into said aligned position.

3. The apparatus of claim 1 wherein said drive means includes a drive roller pivotally supported off center of rotation thereof and flexible coupling means supporting said drive roller enabling said drive roller to assume said inclined attitude.

4. The apparatus of claim 3 wherein said idler means comprises an idler roller cooperating with said drive roller to urge the documents toward the longitudinal position.

5. In a document sorter having a hopper adapted to support a plurality of documents therein, feed and separating means adjacent said hopper for initiating transport of documents therefrom in singular manner, an upright passageway beyond the feed and separating means for transporting documents, rotatable drive means pivotally mounted to attain a normally inclined position and engageable with the documents for driving thereof downwardly within and along said passageway, and rotatable idler means operably associated with said drive means and including bearing means pivotally mounted off center of rotation of said idler means to permit said idler means to cooperate with said drive means as positioned to continually urge the documents into a longitudinally aligned attitude as the documents are transported along said passageway.

6. In the sorter of claim 5 wherein said drive means is supported by a flexible coupling and frictionally engages the documents.

7. In the sorter of claim 5 wherein said drive means includes a drive roller carried by flexible coupling means and pivotally supported off center of rotation thereof permitting inclined positioning of said drive roller in driving relationship with said idler means to urge the documents toward the aligned position.

8. In the sorter of claim 6 wherein said drive means includes a support pivot off center of rotation thereof enabling said drive means to assume said inclined position.

9. In the sorter of claim 8 wherein said idler means includes a support pivot spaced from the center of rotation thereof enabling said idler means to assume an inclined position corresponding with that of said drive means.

10. In the sorter of claim 9 including stop members limiting the extent of inclined positioning of said drive means and said idler means.

11. Apparatus for aligning documents including frame means, rotatable drive means pivotally supported off center of rotation thereof and engageable with the documents for driving thereof in a downwardly inclined direction, and rotatable idler means pivotally supported off center of rotation thereof and engagable with the documents and cooperating with said rotatable drive means for urging the documents into a longitudinally aligned position, said rotatable idler means including bearing means having a portion thereof supported from said frame means for providing said off center pivotal support of said idler means thereby permitting a normally inclined attitude of said rotatable idler means.

12. The apparatus of claim 11 wherein said rotatable drive means includes a rotatable inner portion and a fixed outer portion, said outer portion being supported from said frame means for providing said off center pivotal support of said drive means and said frame means includes stop means limiting the extent of inclined positioning of said drive means.

13. The apparatus of claim 11 wherein said rotatable idler means includes a rotatable inner portion and a fixed outer portion, said outer portion being connected to said frame means for permitting the inclined attitude of said idler means corresponding to that of said drive means and said frame means includes stop means limiting the extent of inclined positioning of said idler means.

14. The apparatus of claim 11 wherein said rotatable drive means includes flexible coupling means permitting inclined driving relationship thereof with said rotatable idler means to urge the documents in said downwardly inclined direction.

* * * * *